US008901447B2

(12) United States Patent
Manzoni et al.

(10) Patent No.: US 8,901,447 B2
(45) Date of Patent: Dec. 2, 2014

(54) CIRCUIT BREAKER WITH PARALLEL RATED CURRENT PATHS

(75) Inventors: Claudio Manzoni, Sedrina BG (IT); Javier Mantilla, Wettingen (CH); Nicola Gariboldi, Nussbaumen (CH); Stephan Grob, Baden (CH); Jasmin Smajic, Schoefflisdorf (CH); Mathias-Dominic Buergler, Wettingen (CH)

(73) Assignee: ABB Technology AG, Zurich (CH)

( * ) Notice: Subject to any disclaimer, the term of this patent is extended or adjusted under 35 U.S.C. 154(b) by 603 days.

(21) Appl. No.: 12/889,054

(22) Filed: Sep. 23, 2010

(65) Prior Publication Data

US 2011/0084048 A1 Apr. 14, 2011

(30) Foreign Application Priority Data

Oct. 8, 2009 (EP) ..... 09172559

(51) Int. Cl.
*H01H 33/12* (2006.01)
*H01H 33/16* (2006.01)

(52) U.S. Cl.
CPC ..... *H01H 33/16* (2013.01); *H01H 33/12* (2013.01)
USPC ..... 218/78; 218/140

(58) Field of Classification Search
CPC ..... H01H 33/00; H01H 33/12; H01H 33/16; H01H 33/80; H01H 33/83
USPC ..... 218/143, 146, 43, 46–65, 74, 76
See application file for complete search history.

(56) References Cited

U.S. PATENT DOCUMENTS 3,686,453 A 8/1972 Floessel
4,421,962 A * 12/1983 Thuries et al. ..... 218/143
4,596,910 A 6/1986 Berta et al.

(Continued)

FOREIGN PATENT DOCUMENTS

CH 519 778 A 2/1972
DE 33 41 903 A1 5/1985

(Continued)

OTHER PUBLICATIONS

European Search Report for EP 09172559.8 dated Mar. 24, 2010.

(Continued)

*Primary Examiner* — Amy Cohen Johnson
*Assistant Examiner* — Marina Fishman
(74) *Attorney, Agent, or Firm* — Buchanan Ingersoll & Rooney PC

(57) ABSTRACT

A circuit breaker is provided which can be filled with a quenching gas and which has two contact arrangements, which can be moved relative to one another and along a longitudinal axis of the circuit breaker. The contact arrangements form a arcing contact system and a rated current contact system connected electrically in parallel with it. One of the contact arrangements includes inner rated current contacts and outer rated current contacts of the rated current contact system, where the inner rated current contacts overhang the outer rated current contacts in the direction of the longitudinal axis, and the outer rated current contacts coaxially surround the inner rated current contacts. The circuit breaker has a high current carrying capability as well as a reliable switching-on and -off behavior, such as during and after the occurrence of a short-circuit current in the circuit breaker.

28 Claims, 3 Drawing Sheets

(56) References Cited

U.S. PATENT DOCUMENTS

| | | | | |
|---|---|---|---|---|
| 4,707,576 | A | 11/1987 | Gessinger et al. | |
| 5,091,614 | A | 2/1992 | Yamamoto et al. | |
| 5,162,627 | A | 11/1992 | Dufournet et al. | |
| 6,163,001 | A * | 12/2000 | Zehnder et al. | 218/46 |
| 6,207,917 | B1 * | 3/2001 | Lehmann et al. | 218/43 |

FOREIGN PATENT DOCUMENTS

| | | | |
|---|---|---|---|
| EP | 1 837 889 | A2 | 9/2007 |
| JP | 50-093261 | U | 8/1975 |
| JP | 61-296610 | A | 12/1986 |
| JP | 62-026724 | A | 2/1987 |
| JP | 02-236923 | A | 9/1990 |
| JP | 04-262333 | A | 9/1992 |

OTHER PUBLICATIONS

Office Action (First Office Action) dated Jun. 26, 2012, issued in corresponding Japanese Patent Application No. 2010-228021, and an English Translation thereof. (6 pages).

* cited by examiner

CIRCUIT BREAKER WITH PARALLEL RATED CURRENT PATHS

RELATED APPLICATION

This application claims priority under 35 U.S.C. §119 to European Patent Application No. 09172559.8 filed in Europe on Oct. 8, 2009, the entire content of which is hereby incorporated by reference in its entirety.

FIELD

The present disclosure is related to the field of medium-voltage and high-voltage technologies. More particularly, the present disclosure is related to circuit breakers with a high current carrying capability in the medium-voltage and high-voltage ranges.

BACKGROUND INFORMATION

By way of example, a circuit breaker of the type mentioned initially is known from DE 3341903 A1. The known circuit breaker has switching pieces which move with respect to one another and whose arcing and rated current contacts are moved along a common longitudinal axis of the switch. During the switching-on movement, the moving arcing contact is moved into the stationary arcing contact. All the rated current contacts, which are in the form of fingers, of the moving switching piece are arranged coaxially with respect to and at the same distance from the arcing contact. Some of the rated current contact fingers are positioned in front of the other rated current contact fingers in the direction of the longitudinal axis. During the switching-on movement, the rated current contacts, which are in the form of fingers, move over the opposing rated current contact, which is in the form of a cylindrical switching piece, and the current is first commutated through the already closed arcing contacts onto the leading rated current contact fingers, and then onto the other, shorter rated current contact fingers. The leading rated current contact fingers are designed to be arc-resistant, for this purpose. When the rated current contact system is closing, all the rated current contacts, which are in the form of fingers, exert a mechanical pressure force onto the internal opposing rated current contact piece. The pressure force is additionally reinforced by the electromagnetic force which occurs as a result of the current flow in the rated current contacts. This leads to a high pressure force, and therefore, to a high total friction force between the rated current contacts which are making contact. The friction force must be overcome by the drive during the opening and closing phase of the switch. In this and other switches, the current flowing via the outer rated current contact fingers to the opposing rated current contact causes an electromagnetic force which, in the event of a short-circuit, can exceed the mechanical friction force which occurs on the switch, and can thus complicate or even render impossible the opening and closing movement of the switch.

In this and other circuit breakers, there are limitations on the current carrying capability and the contact characteristics of the rated current contacts of the switch, such as in the event of a short-circuit in the switch, for example.

SUMMARY

An exemplary embodiment provides a circuit breaker which includes a body configured to be filled with a quenching gas. The exemplary circuit breaker also includes two contact arrangements which are configured to be moved relative to one another and along a longitudinal axis. The contact arrangements have an arcing contact system and a rated current contact system connected electrically in parallel with arcing contact system. The rated current contact system has a lower electrical resistance than the arcing contact system, and is configured to permanently carry a rated current flowing in the circuit breaker. One of the contact arrangements includes inner rated current contacts and outer rated current contacts of the rated current contact system. The inner rated current contacts are configured to overhang the outer rated current contacts in the direction of the longitudinal axis, and the outer rated current contacts coaxially surround the inner rated current contacts.

An exemplary embodiment provides a method for switching on an electrical circuit breaker for high-voltage or medium-voltage. The circuit breaker has two contact arrangements which have a arcing contact system with arcing contacts and a rated current contact system connected electrically in parallel with the arcing contact system. The rated current contact system has a lower electrical resistance than the arcing contact system and is configured to permanently carry a rated current which flows in the circuit breaker. The exemplary method includes moving both contact arrangements relative to one another and along a longitudinal axis of the circuit breaker. The exemplary method also includes, in a first phase, making contact between the arcing contact, which is in the form of a hollow cylinder, and the arcing contact, which acts as an opposing contact and is in the form of a hollow cylinder, on end faces of the hollow cylinder. In a subsequent phase, the exemplary method includes making contact with the rated current contact system, which has an opposing rated current contact, inner rated current contacts and outer rated current contacts. The exemplary method also includes overhanging the inner rated current contacts on the outer rated current contacts in the direction of the longitudinal axis, coaxially surrounding the inner rated contacts with the outer rated current contacts, and causing the inner rated current contacts to make contact with the opposing rated current contact first, followed by the outer rated current contacts.

BRIEF DESCRIPTION OF THE DRAWINGS

Additional refinements, advantages and features of the present disclosure are described in more detail below with reference to exemplary embodiments illustrated in the drawings, in which.

Figure 1:
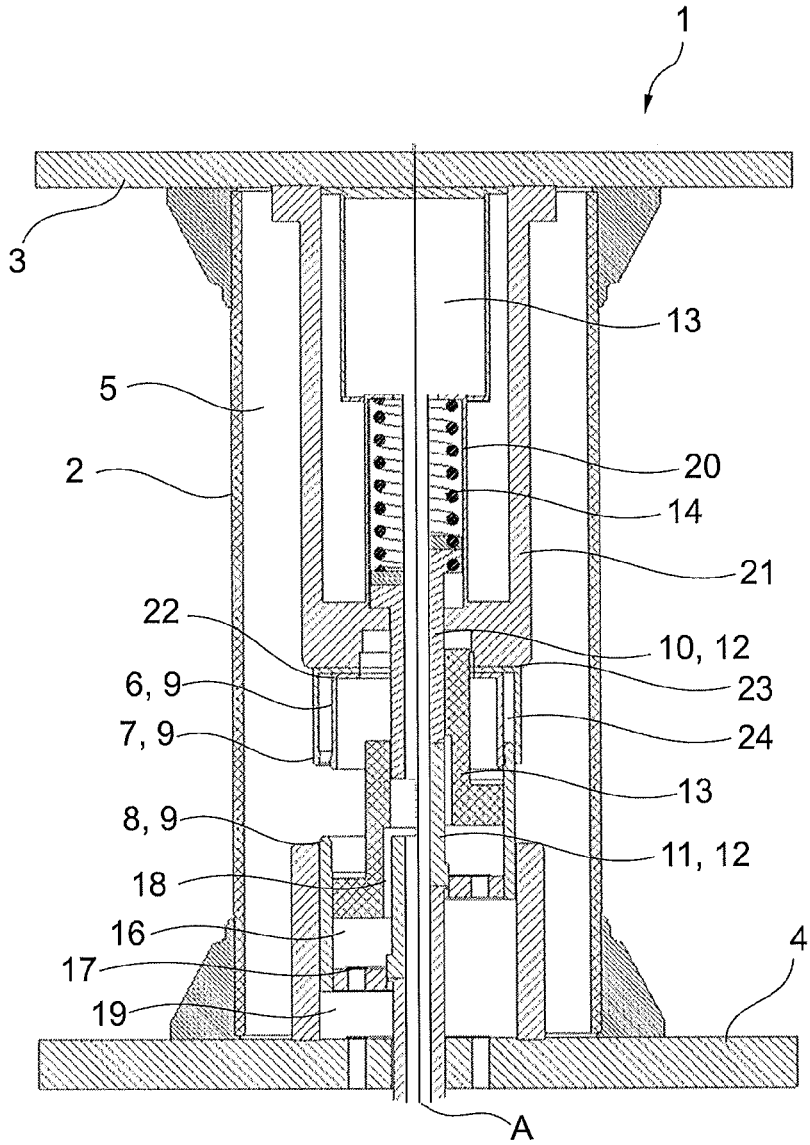
FIG. 1 shows a view of a longitudinal section through a circuit breaker according to an exemplary embodiment of the present disclosure, in which the switch is illustrated in the switched-off position in the left-hand half of the drawing, and in the switched-on position in the right-hand half of the drawing.

The reference symbols used in the drawings and their meanings are listed in summarized form in the list of reference symbols. In principle, identical parts or parts having the same effect are provided with the same or similar reference symbols in the drawings. In some cases, parts which are not essential for understanding of exemplary embodiments of the present disclosure are not illustrated. The described exemplary embodiments represent examples of the subject matter of the disclosure, and have no restrictive effect.

DETAILED DESCRIPTION

Exemplary embodiments of the present disclosure provide a circuit breaker which has an increased current carrying capability and which also improves the contact made by the rated current contacts when the switch is being closed and opened.

Exemplary embodiments of the present disclosure provide an apparatus and a method which achieve these features.

According to an exemplary embodiment of the present disclosure, a circuit breaker can be advantageously filled with a quenching gas and contain two contact arrangements, which can be moved relative to one another and along a longitudinal axis of the switch. The contact arrangements include an arcing contact system and a rated current contact system. The rated current contact system is connected electrically in parallel with the arcing contact system. An arc may burn between the arcing contacts in the arcing contact system. One of the two contact arrangements has inner rated current contacts and outer rated current contacts, wherein the inner rated current contacts are positioned in front of the outer rated current contacts in the direction of the longitudinal axis, that is, the inner contacts overhang the outer contacts along the longitudinal direction of the switch. During a closing movement of the switch, the inner rated current contacts therefore make contact before the outer rated current contacts. Since this results in the short-circuit current in the event of a short circuit being commutated from the arcing contacts only to the inner rated current contacts during the switching-on process and in the current being commutated from the inner rated current contacts only onto the arcing contacts during a switching-off process, the wear caused by commutation in the event of a short circuit occurs only on the inner rated current contacts, and is prevented on the outer rated current contacts. The functionality of the switch is therefore improved, such as after a short-circuit has occurred, for example. The outer rated current contacts are arranged in the form of a ring and coaxially surround the inner rated current contacts. The inner rated current contacts are in turn arranged in the form of a ring around the arcing contact system. The arrangement of the additional inner rated current contacts within the outer rated current contacts leads to the total available rated current contact area being enlarged, which leads to the switch having a greater current carrying capability, without changing the switch volume. In order to distinguish between this and a arcing contact system or an auxiliary contact system which, for example, has a switching-on resistance, the rated current contact system of the circuit breaker in this case means that contact system which has the comparatively lowest electrical resistance and is configured to permanently carry the rated current flowing in the switch.

In accordance with an exemplary embodiment of the present disclosure, the coaxial arrangement of the outer rated current contacts around the inner rated current contacts, which are arranged in the form of a ring on the inside, forms an annular gap between the inner rated current contacts and the outer rated current contacts, into which the opposing rated current contact is moved when the switch is being closed. The opposing rated current contact is therefore clamped in between the inner and the outer rated current contacts in the annular gap that is formed, and therefore makes contact with both the inner and the outer rated current contacts. The split in the current flow between the inner and the outer rated current contacts is advantageous since the current does not all flow via the outer rated current contacts, thus reducing the electromagnetic force caused by the current flow through the outer contacts. The electromagnetic force, which is reduced because of the reduced current flow via the outer contacts, reduces the contact pressure on the opposing rated current contact with which contact is made, and therefore reduces the friction force which acts between the rated current contacts and the opposing rated current contact during movement of the contact arrangements when, for example, a short-circuit occurs in the switch.

In accordance with an exemplary embodiment of the present disclosure, the arcing contact system has two moving, hollow-cylindrical arcing contacts, which make contact on their end faces when the switch is in the closed state. In this context, the end face or end surface means that surface which bounds the envelope surface of the hollow-cylindrical arcing contacts. It has been found to be advantageous for the arcing contacts to make end-face contact, in comparison to those contact systems in which the contacts overlap, since there is no need for the switch drive to overcome the friction force caused by the overlap.

An exemplary embodiment of the present disclosure provides a method for switching on an electrical circuit breaker for the high-voltage or medium-voltage range. The circuit breaker includes two contact arrangements which form an arcing contact system with arcing contacts and a rated current contact system connected electrically in parallel with it. The exemplary method includes moving both contact arrangements relative to one another, toward one another and along a longitudinal axis of the switch. During a first phase of the switching-on movement, both arcing contacts of the arcing contact system make contact with one another on their end faces. This means that the end surfaces abut against one another, with both arcing contacts being in the form of hollow cylinders. Once the arcing contacts have made electrical contact, the rated current contacts of the rated current contact system make contact with one another in a further phase. In this further phase, the inner rated current contacts, which overhang the outer rated current contacts in the direction of the longitudinal axis, make contact with the opposing rated current contact first, and the outer rated current contacts make contact with this opposing rated current contact only after this contact has been made. The inner rated current contacts are coaxially surrounded by the outer rated current contacts. This sequential contact-making process of the inner and outer rated current contacts ensures that the outer rated current contacts, which make contact later, are not subject to wear caused by the current flowing when contact is made. Because the inner rated current contacts make contact first during the switching-on phase, an electromagnetic force is created at the moment when contact is made and when current flows. The electromagnetic force is directed such that it counteracts the pressure force between the opposing rated current contact and the inner rated current contact. This reduces the friction force which occurs during the switch movement and has to be overcome by the switch drive. The process of making contact is therefore improved during the switching-on and switching-off processes, and in particular in the event of a short circuit.

Circuit breakers such as these, which can be used as generator switches for example, can be used, for example, in order to completely disconnect a wind farm with a multiplicity of wind power installations from the electrical power supply grid, and to connect a wind farm such as this to the electrical power supply grid.

FIG. 1 shows a detailed view of a circuit breaker 1 according to an exemplary embodiment of the present disclosure. In the illustrated exemplary embodiment, the circuit breaker 1 is shown in the form of a generator switch. According to an exemplary embodiment, the circuit breaker 1 can be designed for a rated voltage of 24 KV, a nominal current of 6300 amperes, and a nominal frequency of 50/60 Hertz, for example. The circuit breaker 1 has a hollow-cylindrical dielectric body 2, which is flanged-in in a gas-tight manner between power connections 3, 4. The left-hand part of FIG. 1 shows the switch 1 in the open state. The right-hand part of FIG. 1 shows the switch 1 in the closed state. The circuit breaker 2 has two contact arrangements, which are both arranged in the switching chamber volume 5 bounded by the dielectric body 2 and the two power connections 3, 4, and which can move relative to one another along the longitudinal axis A of the switch 1, in order to allow the switch 1 to be switched on and off. The two contact arrangements have an arcing contact system 12, which is coaxially surrounded by a rated current contact system 9. The arcing contact system 12 includes arcing contacts 10 and 11, where the rated current contact system 9 includes inner rated current contacts 6, outer rated current contacts 7 and opposing rated current contact 8.

One of the two contact arrangements has the arcing contact 10, which can be in the form of a hollow cylinder and be arranged along the switch longitudinal axis A, as well as the rated current contact 8 which surrounds the arcing contact 11. The rated current contact 8 can likewise be cylindrical. An insulating nozzle 13 is arranged between the rated current contact 8 and the arcing contact 11 in order to guide a quenching gas flow, for example, a sulfur hexafluoride flow ($SF_6$). The insulating nozzle 13 overhangs the rated current contact 8 and the arcing contact 11 in the direction of the longitudinal axis A. A heating channel 18 is formed between the insulating nozzle 13 and the arcing contact 11, and opens into a heating volume 16. The heating volume 16, which is essentially bounded by the rated current contact 8, the insulating nozzle 13 and the arcing contact 11, is connected via a valve 19 to a compression volume 17 in the switch 1.

The other of the two contact arrangements includes the arcing contact 10 which is arranged in the switching chamber volume 5, the inner rated current contacts 6 and the outer rated current contacts 7. The hollow-cylindrical arcing contact 10 can be moved against the force of a spring 14 along the longitudinal axis A and be guided by the spring 14 in a tubular section 20, which opens into a blow-out volume 13. Quenching gas can therefore escape through the hollow arcing contact 10 into the blow-out volume 13. The inner rated current contacts 6 can be in the form of elastic contact fingers and form a ring 22 of contact fingers, coaxially around which the outer rated current contact 7 are arranged, which are likewise in the form of elastic contact fingers and likewise form a ring 23 of contact fingers. The coaxial arrangement of the outer rated current contacts 7 around the inner rated current contacts 6 makes it possible to increase the number of rated current contact fingers, and therefore to enlarge the effected contact area on the switch 1, which in turn increases the current carrying capability of the circuit breaker 1, without having to increase the diameter or the volume of the circuit breaker 1. The current density to be transmitted per switch volume unit can therefore be increased.

Both the ring 22, which is formed by the inner rated current contacts 6, and the ring 23, which is formed by the outer rated current contacts 7, are firmly connected to a rated current contact supporting body 21 in the switch 1. The ring 22 and the ring 23 can be fixed (e.g., screwed) onto the rated current contact supporting body 21, thus allowing the inner rated current contacts 6 and the outer rated current contacts 7 to be replaced easily.

As illustrated in FIG. 1, the inner rated current contacts 6 overhang the outer rated current contacts 7 in the direction of the longitudinal axis A, and are therefore positioned in front of the outer rated current contacts 7. The inner and outer rated current contacts 6 and 7 are electrically conductively connected to one another.

Figure 2A:
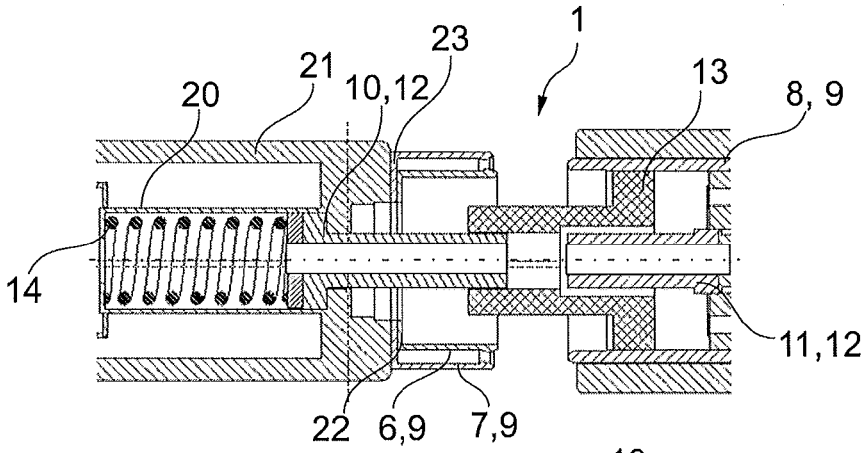
FIG. 2 shows a view of a longitudinal section through a circuit breaker according to an exemplary embodiment of the present disclosure, illustrating different switch states from the switched-off position to the switched-on position.
Figure 2B:
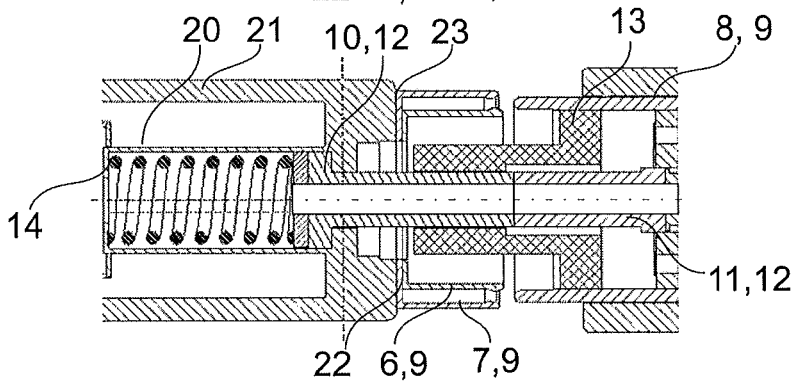
Figure 2C:
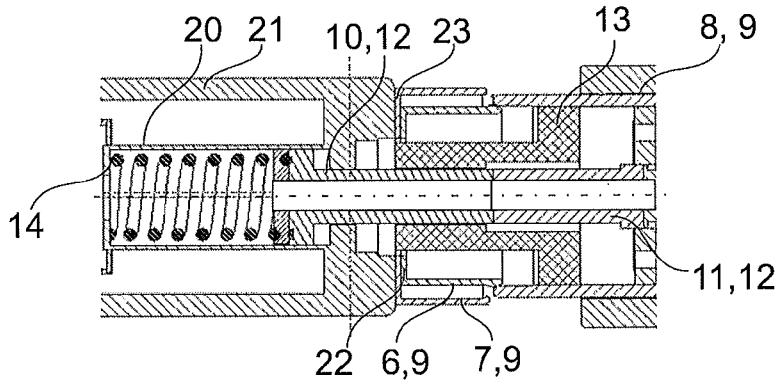
Figure 2D:
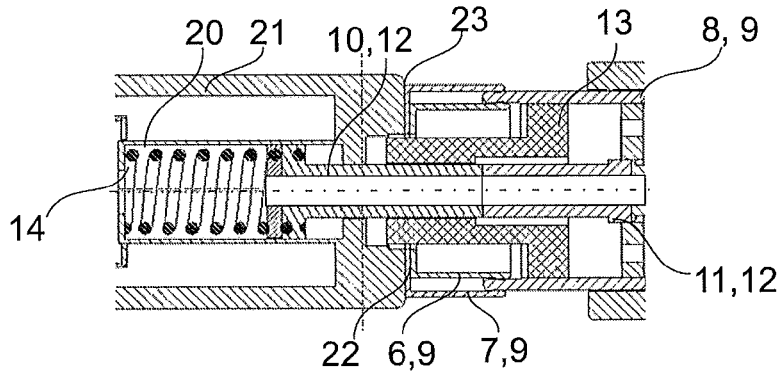

FIGS. 2*a* to 2*d* show the exemplary embodiment of the circuit breaker 1 illustrated in FIG. 1 in various switching states. For example, FIG. 2*a* shows the switch 1 in the "off" switch position, FIG. 2*b* shows the switch 1 in the "arcing contact system contact making" switch position, FIG. 2*c* shows the switch 1 in the "inner rated current contacts contact making" switch position, and FIG. 2*d* shows the switch 1 in the "on" switch position.

During a switching-on movement of the switch 1, the arcing contact 11 is moved with the rated current contact 8 and with the insulating nozzle 13 in the direction of the longitudinal axis A toward the inner and outer rated current contacts 6 and 7 and the arcing contact 10, with an arc being formed between the arcing contact 10 and the arcing contact 11 as they approach. The arc burns until the "arcing contact system contact made" switch position shown in FIG. 2*b* is reached, and two head surfaces of the two arcing contacts 10 and 11 touch, and therefore make electrically conductive contact. All of the current therefore flows via the arcing contact system 12 of the switch 1 in this switch state.

A few milliseconds later, the circuit breaker 1 assumes the "inner rated current contacts contact making" switch position, which is illustrated in FIG. 2*c*. The making of a contact is defined by the moment of the first physical contact between the inner rated current contacts 6 and the opposite rated current contact 8. The external diameter of the ring 22, which is formed from the inner elastic rated current contacts 6, with respect to the internal diameter of the rated current contact 8, which is in the form of a hollow cylinder, is chosen such that the rated current contact 8 is pushed over the rated current contacts 6 while overcoming a contact force, which means that the inside of the rated current contact 8, which is in the form of a hollow cylinder, overlaps and touches the outside of the ring 23, which is formed from rated current contacts 6. Because the electrical resistance in the rated current contact system 9 is much lower than that of the arcing contact system 12, the current is commutated from the arcing contact system 12 onto the rated current contact system 9. As a result, the current flowing in the switch 1 is, at this moment, carried by the rated current contact system 9 and the arcing contact system 12 connected electrically and parallel with it. At the same time, the arcing contact 10 is pressed against the spring force of the spring 14, and the switching-on movement of the arcing contact 11, as it makes contact, pushes it in the direction of the blow-out volume 16.

During the switching-on movement, the rated current contact 8, which is driven by a drive, moves further toward the inner and outer rated current contacts 6 and 7. This results in the "on" switch position being reached, as illustrated in FIG. 2*d*. The internal diameter of the ring 23, which is formed from the outer elastic rated current contacts 7, is, in this case, chosen with respect to the external diameter of the rated current contact 8, which is in the form of a hollow cylinder, such that the inner rated current contacts 6 are pushed over the rated current contacts 8 while overcoming an additional contact force. As a result, the inside of the ring 22, which is formed from rated current contacts 6, overlaps and touches the outside of the rated current contact 8, which is in the form of a hollow cylinder. The rated current contact 8 is therefore clamped in between the inner and outer rated current contacts 6 and 7 by the contact force which is exerted by the inner and outer rated current contacts 6 and 7.

Because the electrical resistance of the inner rated current contacts 6 and of the outer rated current contacts 7 is the same or substantially the same, the current flow in the switch 1 can be split between the inner and outer rated current contacts 6 and 7. In this case, the ring 23 of contacts which is formed from the outer rated current contacts 7 carries about 65% of the total current, for example, while the ring 22 formed from the inner rated current contacts 6 carries about 35% of the current, for example. In the "on" switch position, the current path which is formed by the arcing contacts 10 and 11 is electrically in parallel with the current path which is formed by the inner rated current contacts 6 with the opposing rated current contact 8, and is also in parallel with the current path which is formed by the outer rated current contacts 7 with the opposing rated current contact 8. Because the electrical resistance of the rated current contact system 9 is substantially less than that of the arcing contact system 12, the current flow through the arcing contacts 10, 11 is negligible.

Figure 3:
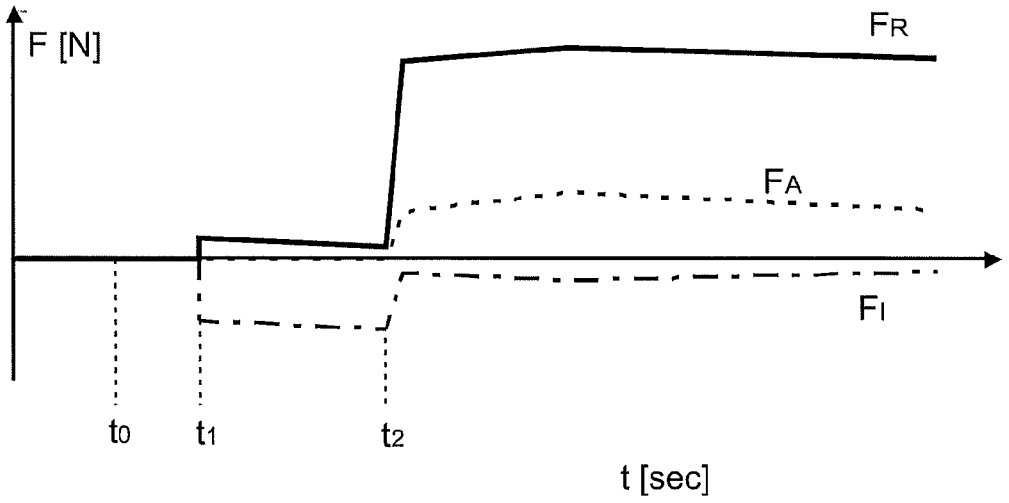
FIG. 3 shows the time profile of the force acting on the rated current contact system during the switching-on movement of the switch as a result of the inner and outer rated current contact fingers making contact with the opposing rated current contact.

The diagram illustrated in FIG. 3 qualitatively illustrates the forces which act on the inner and outer rated current contacts 6 and 7, and illustrates the friction force $F_R$ resulting from this on the rated current contact system 9, which must be overcome by means of the drive in order to ensure the switching-on movement of the contact arrangements. On the one hand, a friction force acts in the direction of the longitudinal axis A against the switching-on movement, caused by the inner and outer rated current contacts 6, 7, which slide on the rated current contact 8. On the other hand, an electromagnetic force occurs, which acts at substantially right angles to the switching-on direction, caused by the current flow in the inner and outer rated current contacts 6, 7. An increasing electrical current in the switch 1 also results in an increasing contact force between the outer rated current contacts 7 and the opposing rated current contact 8.

At the time $t_0$, the switch 1 is in the "off" switch state, as illustrated in FIG. 2*a*. The current flow through the contact arrangements is interrupted, and the sum of the forces acting is zero. During the switching-on movement, the arcing contact system 12 is closed after this at the time $t_1$, and the two arcing contacts 10, 11 touch (FIG. 2*b*), moving through the "inner rated current contacts contact making" switch state, as is illustrated in FIG. 2*c*. In this case, a friction force occurs on the rated current contact system 9 between the opposing rated current contact 8 and the inner rated current contact 6, as a result of the electromagnetic force $F_I$, which is reduced. The force $F_I$ is caused by the current flow in the inner rated current contacts 6. This electromagnetic force $F_I$ counteracts the pressure force between the rated current contact 8 and the inner rated current contact 6. At the moment when the current flow passes through the inner rated current contacts 6, the pressure force and therefore the resultant friction force $F_R$ between the rated current contact 8 and the inner rated current contacts 6 are reduced. The resultant friction force $F_R$ when current is flowing through the inner rated current contacts 6 is therefore less than the friction force which occurs when no current is flowing. As the closing movement of the switch 1 progresses further, the "on" switch position illustrated in FIG. 2*d* is reached at the time $t_2$, after which a friction force additionally occurs, caused by the contact made between the rated current contact 8 and the outer rated current contact 7. At the same time, some of the current is commutated from the inner rated current contacts 6 onto the outer rated current contacts 7. This commutation results on the one hand in the electromagnetic force $F_I$ on the inner rated current contacts 6 decreasing, and at the same time in an electromagnetic force $F_A$ acting on the outer rated current contacts 7, increasing the pressure force on these contacts 7. From the time $t_2$, this therefore results in the resultant friction force $F_R$ including the pressure force of the inner and outer rated current contacts 6 and 7 on the opposing rated current contact 8, and a component of the electromagnetic force $F_I$, which reduces the friction force $F_R$, caused by the current flow in the inner rated current contacts 6, as well as a component of the electromagnetic force $F_A$, which increases the friction force $F_R$, caused by the current flowing in the outer rated current contacts 7. The electric current is split between the rated current contacts 6, 7 in such a way that approximately 65% flows via the outer rated current contacts 7 and approximately 35% flows via the inner rated current contacts 6, for example. The presence of the inner rated current contacts 6 in addition to the outer rated current contacts 7 thus reduces the friction force acting on the contacts in comparison to the force which occurs in a circuit breaker which has only rated current contacts which act from the outside on an internal opposing rated current contact.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

1 Circuit breaker (switch)
2 Dielectric body
3, 4 Power connection
5 Switching chamber volume
6 Inner rated current contacts
7 Outer rated current contacts
8 Rated current contact acting as opposing contact piece; opposing rated current contact
9 Rated current contact system
10 Arcing contact
11 Arcing contact
12 Arcing contact system
13 Insulating nozzle
14 Spring
15 Blow-out volume
16 Heating volume
17 Compression volume
18 Heating channel
19 Valve
20 Tubular section
21 Rated current contact supporting body
22 Ring of the inner rated current contacts
23 Ring of the outer rated current contacts
24 Annular gap
A Longitudinal axis

What is claimed is:

1. A circuit breaker comprising:

a body configured to be filled with a quenching gas; and two contact arrangements which are configured to be moved relative to one another and along a longitudinal axis between an on state in which the contact arrangements are in contact with each other and an off state in which the contact arrangements are not in contact with each other, wherein:

the contact arrangements have an arcing contact system and a rated current contact system connected electrically in parallel with the arcing contact system;

the rated current contact system has a lower electrical resistance than the arcing contact system, and is configured to permanently carry a rated current flowing in the circuit breaker;

one of the contact arrangements comprises inner rated current contacts and outer rated current contacts of the rated current contact system, the inner rated current contacts being configured to overhang the outer rated current contacts in the direction of the longitudinal axis, and the outer rated current contacts coaxially surrounding the inner rated current contacts, wherein the inner and outer rated current contacts are each entirely a unitary contact in both the on and off states, respectively.

2. The circuit breaker as claimed in claim 1, wherein, when the circuit breaker is switched on, the inner rated current contacts and the outer rated current contacts of one contact arrangement are configured to make physical contact with an opposing rated current contact in the other contact arrangement to form two parallel rated current paths.

3. The circuit breaker as claimed in claim 1, wherein the inner rated current contacts are composed of the same metal as the outer rated current contacts, and have the same electrical resistance.

4. The circuit breaker as claimed in claim 1, wherein both the inner rated current contacts and the outer rated current contacts are in the form of elastic contact fingers.

5. The circuit breaker as claimed in claim 4, wherein, when the circuit breaker is switched on, a contact force acts between the inner rated current contact fingers and the outer rated current contact fingers.

6. The circuit breaker as claimed in claim 5, wherein the contact force which acts when the circuit breaker is switched on is directed such that the contact force increases as the current in the circuit breaker rises.

7. The circuit breaker as claimed in claim 2, wherein the opposing rated current contact is in the form of a hollow cylinder.

8. The circuit breaker as claimed in claim 2, wherein the coaxial arrangement of the outer rated current contacts with respect to the inner rated current contacts, which are arranged in the form of a ring, is configured to form an annular gap, into which the opposing rated current contact piece is configured to move when the circuit breaker is being closed.

9. The circuit breaker as claimed in claim 8, wherein the inner rated current contacts are configured to be first brought into contact with the opposing rated current contact, followed by the outer rated current contacts.

10. The circuit breaker as claimed in claim 4, wherein the inner rated current contact fingers and the outer rated current contact fingers are each mounted in the circuit breaker by means of a screw connection.

11. The circuit breaker as claimed in claim 1, wherein the arcing contact system is formed by two moving, hollow-cylindrical arcing contacts, and the arcing contacts are configured to make contact with each other via their respective end faces, when the circuit breaker is switched on.

12. The circuit breaker as claimed in claim 2, wherein the inner rated current contacts are composed of the same metal as the outer rated current contacts, and have the same electrical resistance.

13. The circuit breaker as claimed in claim 2, wherein both the inner rated current contacts and the outer rated current contacts are in the form of elastic contact fingers.

14. The circuit breaker as claimed in claim 13, wherein, when the circuit breaker is switched on, a contact force acts between the inner rated current contact fingers and the outer rated current contact fingers.

15. The circuit breaker as claimed in claim 14, wherein the contact force which acts when the circuit breaker is switched on is directed such that the contact force increases as the current in the circuit breaker rises.

16. The circuit breaker as claimed in claim 12, wherein the opposing rated current contact is in the form of a hollow cylinder.

17. The circuit breaker as claimed in claim 13, wherein the opposing rated current contact is in the form of a hollow cylinder.

18. The circuit breaker as claimed in claim 5, wherein the coaxial arrangement of the outer rated current contacts with respect to the inner rated current contacts, which are arranged in the form of a ring, is configured to form an annular gap, into which the opposing rated current contact piece is configured to move when the circuit breaker is being closed.

19. The circuit breaker as claimed in claim 18, wherein the inner rated current contacts are configured to be first brought into contact with the opposing rated current contact, followed by the outer rated current contacts.

20. The circuit breaker as claimed in claim 6, wherein the coaxial arrangement of the outer rated current contacts with respect to the inner rated current contacts, which are arranged in the form of a ring, is configured to form an annular gap, into which the opposing rated current contact piece is configured to move when the circuit breaker is being closed.

21. The circuit breaker as claimed in claim 20, wherein the inner rated current contacts are configured to be first brought into contact with the opposing rated current contact, followed by the outer rated current contacts.

22. The circuit breaker as claimed in claim 5, wherein the arcing contact system is formed by two moving, hollow-cylindrical arcing contacts, and the arcing contacts are configured to make contact with each other via their respective end faces, when the circuit breaker is switched on.

23. The circuit breaker as claimed in claim 8, wherein, in the on state, the opposing rated current contact piece is clamped in between the inner rated current contact and the outer rated current contact in the formed annular gap.

24. A method for switching on an electrical circuit breaker for high-voltage or medium-voltage, wherein the circuit breaker has two contact arrangements which have a arcing contact system with arcing contacts and a rated current contact system connected electrically in parallel with the arcing contact system, the rated current contact system has a lower electrical resistance than the arcing contact system and is configured to permanently carry a rated current which flows in the circuit breaker, wherein the method comprises:

moving both contact arrangements relative to one another and along a longitudinal axis of the circuit breaker between an on state in which the contact arrangements are in contact with each other and an off state in which the contact arrangements are not in contact with each other;

in a first phase, making contact between the arcing contact, which is in the form of a hollow cylinder, and the arcing contact, which acts as an opposing contact and is in the form of a hollow cylinder, on end faces of the hollow cylinder; and in a subsequent phase, making contact with the rated current contact system, which has an opposing rated current contact, inner rated current contacts and outer rated current contacts, wherein the method comprises:

overhanging the inner rated current contacts on the outer rated current contacts in the direction of the longitudinal axis;

coaxially surrounding the inner rated contacts with the outer rated current contacts; and causing the inner rated current contacts to make contact with the opposing rated current contact first, followed by the outer rated current contacts, and wherein the inner and outer rated current contacts are each entirely a unitary contact in both the on and off states, respectively.

25. The method as claimed in claim 24, comprising:

forming two parallel rated current paths by the inner rated current contacts and the outer rated current contacts making contact with the common opposing rated current contact.

26. The method as claimed in claim 24, comprising:

moving the opposing rated current contact piece into an annular gap which is formed by the coaxial arrangement of the outer rated current contacts with respect to the inner rated current contacts, which are arranged in the form of a ring.

27. The method as claimed in claim 25, comprising:

moving the opposing rated current contact piece into an annular gap which is formed by the coaxial arrangement of the outer rated current contacts with respect to the inner rated current contacts, which are arranged in the form of a ring.

28. The method as claimed in claim 26, wherein, in the on state, the opposing rated current contact piece is clamped in between the inner rated current contact and the outer rated current contact in the formed annular gap.

* * * * *